US005283932A

United States Patent [19]

Richardson et al.

[11] Patent Number: 5,283,932

[45] Date of Patent: Feb. 8, 1994

[54] FLEXIBLE PLASTIC ZIPPER SLIDER WITH RIGIDIZING STRUCTURE FOR ASSEMBLY WITH PROFILED PLASTIC ZIPPER

[75] Inventors: Dale S. Richardson, Westerville; Roger W. Smith, Jackson Township Jackson County, both of Ohio

[73] Assignee: Mobil Oil Corporation, Fairfax, Va.

[21] Appl. No.: 74,577

[22] Filed: Jun. 10, 1993

[51] Int. Cl.[5] ..... A44B 19/00

[52] U.S. Cl. ..... 24/400; 24/415; 24/587

[58] Field of Search ..... 24/400, 399, 415, 587, 24/576, 297, 430, 543, 30.5; 383/63, 65, 69

[56] References Cited

U.S. PATENT DOCUMENTS

| | | | |
|---|---|---|---|
| 2,810,944 | 10/1957 | Sander | 24/400 |
| 5,007,143 | 4/1991 | Herrington | 24/400 |
| 5,010,627 | 4/1991 | Herrington et al. | 24/400 |
| 5,020,194 | 6/1991 | Herrington et al. | 24/400 |
| 5,063,644 | 11/1991 | Herrington et al. | 24/400 |
| 5,070,583 | 12/1991 | Herrington | 24/400 |

*Primary Examiner*—Victor N. Sakran
*Attorney, Agent, or Firm*—Alexander J. McKillop; George W. Hager, Jr.

[57] ABSTRACT

A flexible plastic slider having sidewalls normally diverging outwardly and spaced apart a distance adequate for transverse installation of the slider over the profiled elements of a zipper with rigidizing structure on the slider to move the sidewalls into and retain them in an assembled position on the zipper to prevent the slider from being lifted off the zipper.

7 Claims, 5 Drawing Sheets

FLEXIBLE PLASTIC ZIPPER SLIDER WITH RIGIDIZING STRUCTURE FOR ASSEMBLY WITH PROFILED PLASTIC ZIPPER

BACKGROUND OF THE INVENTION

The present invention relates to improvement in plastic sliders for opening and closing plastic reclosable fasteners or zippers on plastic bags and the like and particularly to flexible plastic sliders for assembly with the zipper by transverse movement.

Plastic zippers with plastic sliders are well known in the art. The type of plastic zippers to which the present invention relates have profiles that include a pair of male and female fastener elements in the form of reclosable interlocking rib and groove elements with a slider for opening and closing the rib and groove elements. In the manufacture of plastic-film bags, a pair of these male and female fastener elements extend along the mouth of the bag and these male and female elements are adapted to be secured in any suitable manner to the flexible walls of the plastic-film bags.

Sliders for opening or closing the reclosable fasteners are essentially U-shaped and are adapted to be assembled with the zipper by threading them onto the end of the zipper or by a relative transverse maneuver. To facilitate the transverse maneuver, some of the sliders have been provided with folding sidewalls and others have been assembled on the zipper from multiple parts. In some instances, the multiple parts of the plastic slider have been ultrasonically welded together and in other instances the multiple parts of the slider have been constructed to be snapped together. In each of these prior art multi-part plastic sliders the various parts have been assembled together in a direction transverse to the axis of the zipper. Examples of patents showing multi-part plastic sliders are shown in U.S. Pat. No. 5,007,142 - Herrington, U.S. Pat. No. 5,007,143 Herrington and U.S. Pat. No. 5,020,194 - Herrington et al. Examples of patents showing plastic sliders with folding sidewalls are shown in U.S. Pat. No. 5,010,627 - Herrington et al, 5,063,644 - Herrington et al and U.S. Pat. No. 5,070,583 - Herrington.

It would be desirable to provide a flexible plastic slider having sidewalls normally diverging outwardly and spaced apart a distance adequate for transverse installation over the profile elements of a zipper with rigidizing structure on the slider to move the sidewalls into and retain them in an assembled position on the zipper to prevent the slider from being lifted off the zipper.

SUMMARY OF THE INVENTION

It is an object of the present invention to provide an improved flexible plastic slider for straddling a profile plastic reclosable fastener particularly suited for thermoplastic bags for opening and closing the fastener wherein the slider is constructed for transverse installation over the reclosable fastener without interfering with or deforming the fastener during transverse assembly of the slider therewith and wherein the slider includes rigidizing structure for locking the slider onto the fastener.

In accordance with the present invention there is provided a flexible plastic slider for straddling a profiled plastic reclosable fastener particularly suited for plastic-film bags for opening and closing the fastener. The slider is constructed for assembly with the fastener by transverse movement. The slider comprises a support member having a separator finger depending therefrom for insertion between the elements of the reclosable fastener. A pair of sidewalls depend from the support member and are located on opposite sides of the separator finger. The sidewalls have at the lower margins thereof inwardly extending shoulder structures. The sidewalls of the uninstalled slider diverge outwardly so that the inwardly extending shoulder structures are spaced apart a distance adequate for transverse installation over the profile elements of the reclosable fastener without interference. The slider includes rigidizing structure for moving the sidewalls into and retaining them in an assembled position on the fastener whereby the shoulders cooperate with the bottom of the reclosable fastener to prevent the slider from being lifted off the top of the fastener while the slider straddles the fastener.

In one aspect of the invention the rigidizing structure on the slider to move the sidewalls into and retain them in an assembled position comprises a U-shaped elongated member carried by the support member and adapted for movement downwardly over the sidewalls to cause the sidewalls to move from their diverging position to the assembled position with the shoulders engaging the profiles of the fastener. The sidewalls are relatively flexible and the U-shaped member is rigid whereby when the U-shaped member is snapped into place over the support member the sidewalls are pressed inwardly so that the shoulders engage the profiles of the fastener to prevent removal of the now-rigid slider from the fastener.

In accordance with another aspect of the invention the support member is a flexible member bowed downwardly for maintaining the depending rigid sidewalls of the unassembled slider in outwardly diverging relation and the rigidizing structure on the slider to move the sidewalls into and retain them in an assembled position comprises a member slidably engaged with the support member and with the upper ends of the sidewalls, the slidable member being constructed to be axially pressed into place to straighten the support member thereby causing the sidewalls to converge so that their shoulders engage the profile elements to prevent removal of the slider from the fastener.

In accordance with another aspect of the invention, the support member is a flexible member bowed downwardly for maintaining the rigid sidewalls of the unassembled slider in diverging position and the structure on the slider for moving the sidewalls into and retaining them in an assembled position comprises an over-center rigidizing member located above the support member and having its opposite edges connected to the upper ends of the pair of sidewalls. The over-center rigidizing member comprises two rigid portions separated by a thinned hinge area initially bowing upwardly away from the flexible support member whereby when the over-center rigidizing member is pressed downward, the support member straightens and the rigidizing member moves over-center and remains bowed slightly against the support member to maintain the support member straight.

In accordance with a further aspect of the invention, the support member is flexible and bowed downwardly for normally maintaining the depending rigid sidewalls of the unassembled slider in outwardly diverging relation, the upper ends of the sidewalls extending above the support member. The rigidizing structure on the slider to move the sidewalls into and retain them in an assembled position comprises a flexible member positioned above the support member and having the opposite edges of the flexible member connected with the upper ends of the pair of sidewalls. The flexible member is initially convex in configuration to permit the pair of sidewalls to maintain a diverging outward condition. The flexible member is constructed so that when pressed downward the flexible member moves overcenter from a convex to a concave configuration thereby straightening the support member and locking the support member in its straightened condition with the pair of sidewalls moved to a non-diverging condition.

In accordance with another aspect of the invention, the support member is flexible and bowed downwardly for maintaining the depending rigid sidewalls of the unassembled slider in outwardly diverging relation, the upper ends of the sidewalls extending above the support member. The rigidizing structure on the slider to move the sidewalls into and retain them in an assembled position comprises a rigid member positioned above the support member and hinged along one edge to the upper end of one of the sidewalls. The support member is flexible so that when the slider is positioned on the profiles, the rigid member is hinged down into a receptacle formed between the upper ends of the sidewalls atop the flexible support member thereby flattening the support member and maintaining the support member in a flattened position and locking the slider in place on the fastener.

Other objects and advantages of the invention will become apparent from the following detailed description of the invention taken in conjunction with the accompanying drawings.

PREFERRED EMBODIMENT OF THE INVENTION

Figure 1:
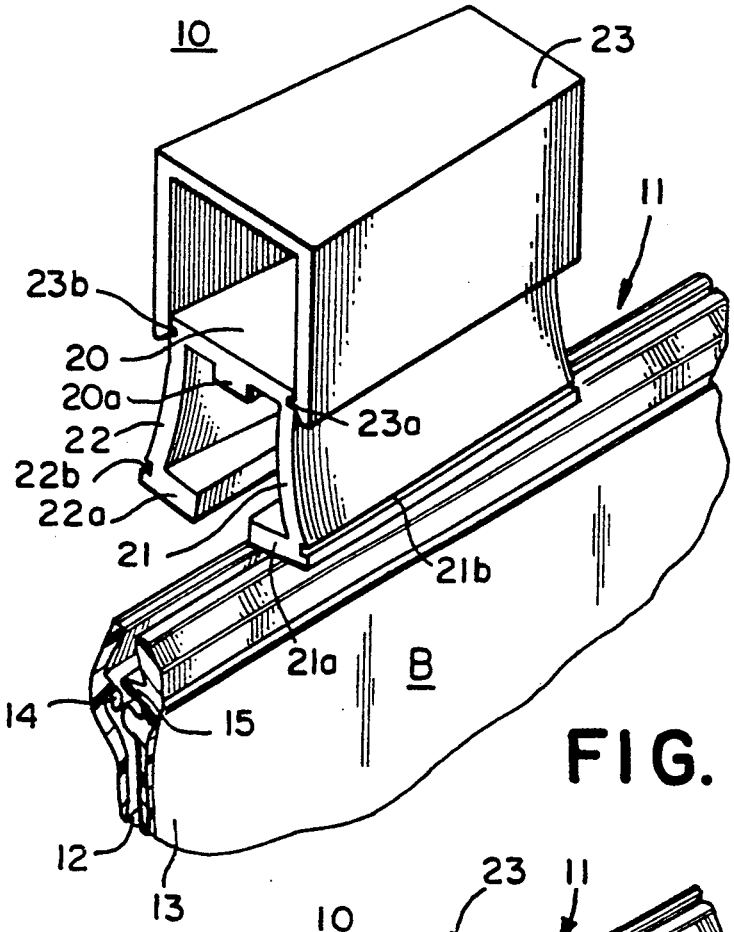
FIG. 1 is a perspective view of a flexible plastic slider embody the present invention preparatory to assembly with a profiled plastic reclosable fastener at the upper edge of a plastic-film bag.

Referring to FIG. 1 there is illustrated a flexible plastic slider 10 embodying the present invention preparatory to assembly with a profiled plastic reclosable fastener or zipper 11. The slider 10 is particularly suited for plastic-film bags and the like and has been illustrated in FIGS. 1 and 2 in connection with a reclosable fastener 11 located at the upper edge of a plastic-film bag B. The bag B is formed by a pair of flexible plastic sheets 12 and 13 having an upper edge with the profiled plastic reclosable fastener 11 at the upper edge extending along the length thereof and having reclosable interlocking rib and groove profile elements 14 and 15 on the facing surfaces thereof. In the manufacture of plastic-film bags, a pair of male and female fastener elements 14 and 15 extend along the mouth of the bag and these (interlocking rib and groove profile) elements are adapted to be secured in any suitable manner to the flexible walls of the plastic-film bags. Plastic-film bags with reclosable fastener elements such as 14 and 15 are well known in the art. For example, see the aforesaid U.S. Pat. No. 5,070,583.

Figure 2:
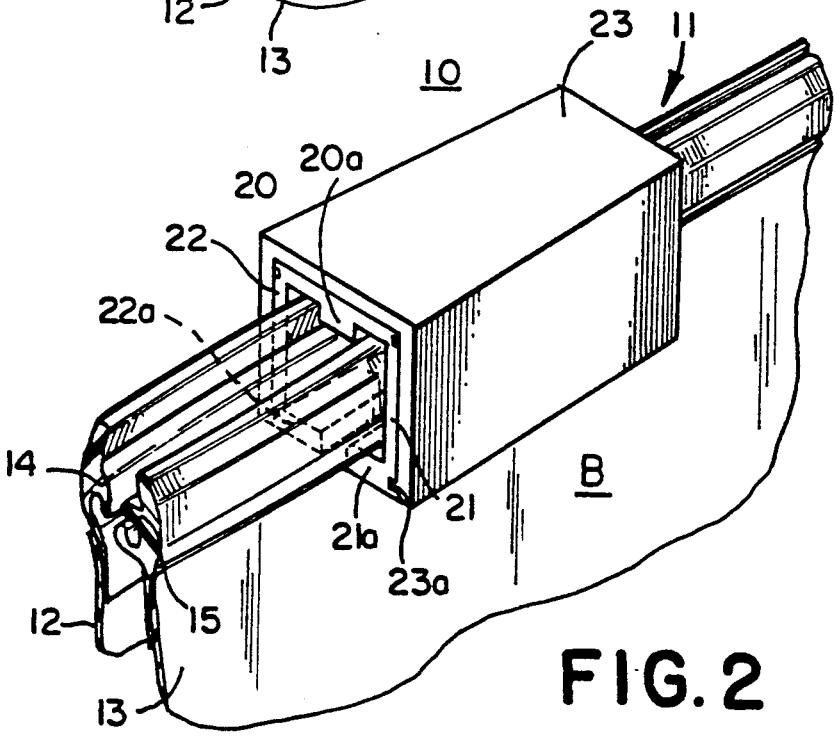
FIG. 2 is a perspective view of the plastic slider shown in FIG. 1 assembled on the profiled plastic reclosable fastener.

Referring to FIG. 1 it will be seen that the novel slider 10 includes a support member 20 having a separator finger 20*a* depending therefrom for insertion between the upper edges of the elements 14 and 15 of the reclosable fastener 11. A pair of flexible sidewalls 21, 22 depend from the support member 20 and are located on opposite sides of the separator finger 20*a*. The sidewalls 21 and 22 have at their lower ends inwardly extending shoulder structures 21*a* and 22*a*. The sidewalls 21 and 22 in an unassembled slider diverge outwardly so that the inwardly extending shoulder structures 21*a* and 22*a* are spaced apart a distance adequate for the transverse installation of the slider 10 over the profile elements 14 and 15 of the reclosable fastener 11 without interference. The slider 10 as thus far described is substantially U-shaped with the relatively flexible sidewalls 21 and 22. The sidewalls 21 and 22 preferably are molded with a slight curvature so that their lower ends diverge and thus permit the shoulders 21*a* and 22*a* to be installed over the profiles 14 and 15 without interference. In installation, the slider is positioned on the reclosable fastener 11 with the support member 20 resting on the upper edges of the profile elements 14 and 15 and the depending finger 22*a* inserted between these edges as shown in FIG. 2. Thereafter, a larger, rigid, U-shaped outer member 23 is snapped into place over the body 20 and flexible sidewalls 21 and 22, pressing the sidewalls inwardly so that their shoulders 21*a* and 22*a* engage the profiles 14 and 15 to prevent removal of the now-rigid slider 10 from the reclosable fastener 11.

The outer member 23 is constructed to engage the slider with a one-way snap fit. As may be seen in FIG. 1 the support member 20 is provided with grooves along its opposite upper edges to receive mating shoulders 23*a*, 23*b* extending along the lower edges of the U-shaped member 23. With the outer member in this position the sidewalls 21 and 22 are still flexible permitting the slider installation in the manner illustrated in FIG. 1. After the slider has been positioned on the profiled elements 14 and 15, the rigid U-shaped outer member 23 is pushed downwardly to rigidize the sidewalls 21 and 22 and permit the shoulders 23*a* and 23*b* on outer member 23 to enter the grooves 21*b* and 22*b* along the lower edges of the sidewalls 21 and 22. Thus it will be seen in FIG. 2 that the outer member 23 engages the inner member of the slider with a one-way snap fit. While the slider 10 shown in FIGS. 1 and 2 is of two-piece construction, it will be seen that preassembly of the U-shaped rigidizing outer member 23 with the support member 20 of the slider enables the slider 10 to be handled as a single component during installation of the slider on the fastener 11.

Figure 3:
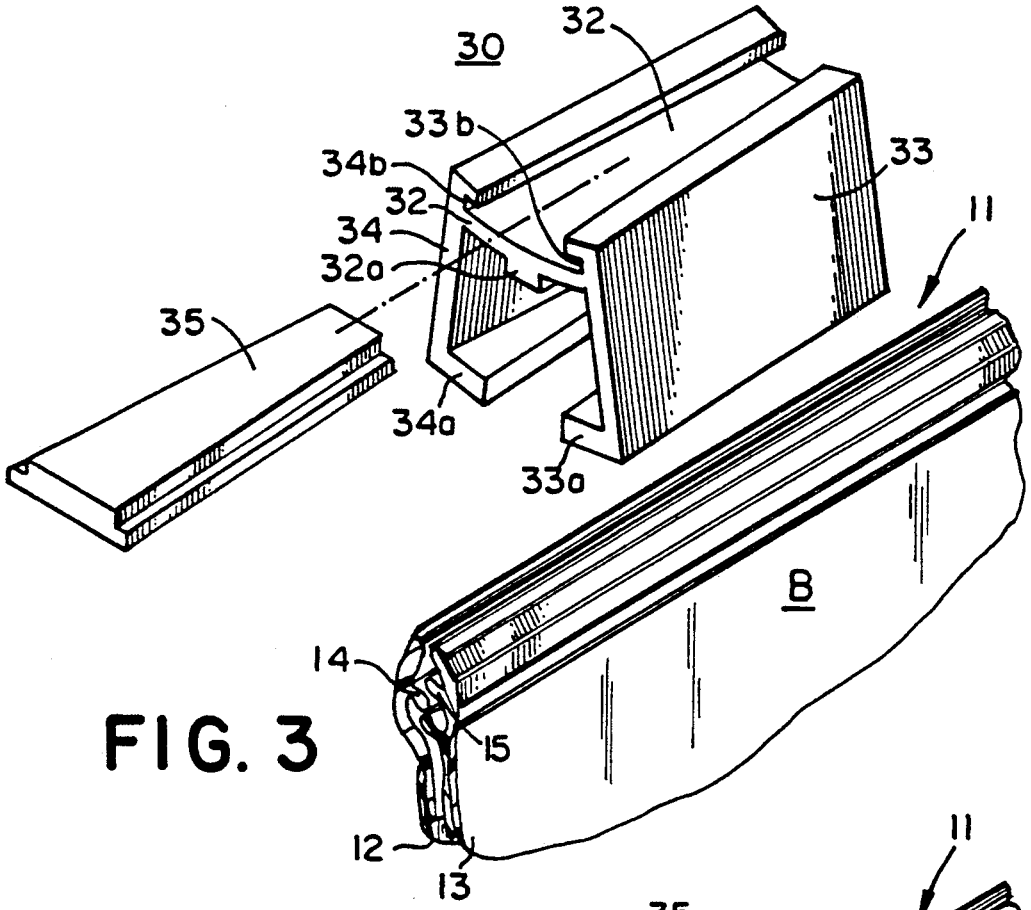
FIG. 3 is a perspective view of a flexible plastic slider embodying a modification of the present invention preparatory to being assembled on the profiled plastic reclosable fastener at the upper edge of a plastic-film bag.
Figure 4:
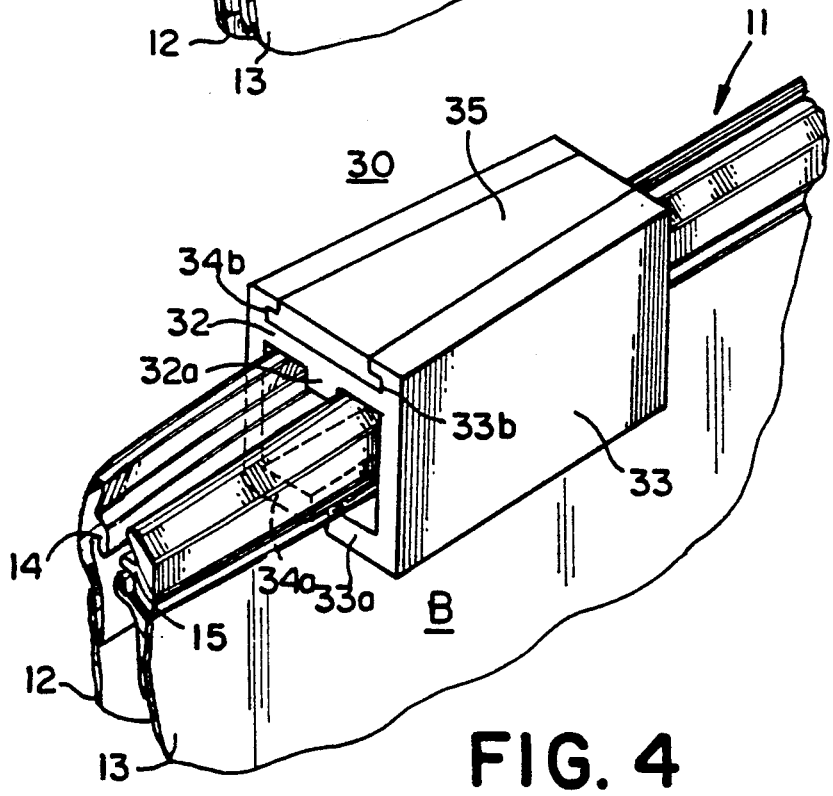
FIG. 4 is a perspective view of the plastic slider illustrated in FIG. 3 assembled on the profiled plastic reclosable fastener.

Referring to FIGS. 3 and 4 there is illustrated a flexible plastic slider 30 embodying a modification of the present invention. The slider 30 as shown in FIG. 3 includes a relatively flexible support member 32 having a separator finger 32*a* depending therefrom for insertion between the upper edges of the elements 14 and 15 of the zipper 11. A pair of rigid sidewalls 33 and 34 depend from the support member 32 and are located on the opposite sides of the finger 32*a*. The sidewalls 33 and 34 have at the lower ends thereof inwardly extending shoulders 33*a* and 34*a* respectively. The support member 32 is molded with a slight downward curvature that causes the sidewalls 33 and 34 to diverge and thus allows the slider 30 to be installed over the profiled elements 14 and 15 of the zipper 11 without interference. The upper ends of the sidewalls 33 and 34 are provided with grooves 33*b* and 34*b* respectively. When the slider has been positioned on the profiled elements 14 and 15 of the zipper 11 with the finger 32*a* therebetween, a keystone-shaped member 35 is slidably engaged with the grooves 33*b*, 34*b* and is axially pressed into place. The keystone-shaped member 35 straightens the support member 32, thereby causing the sidewalls 33 and 34 to converge so that their shoulders 33*a* and 34*a* engage the profiled elements 14 and 15 to prevent removal of the slider 30 from the reclosable fastener 11. This is best seen in FIG. 4. The final position of the keystone-shaped member 35 may be maintained by a press fit, snap-lock, ultrasonic welding, or the like. As in the case of the embodiment of the slider 10 illustrated in FIGS. 1 and 2, the slider 30 of FIGS. 3 and 4 can be installed on the zipper 11 with the keystone-shaped member 35 partially engaged in the grooves 33*b*, 34*b* so that only a single component need be handled during the slider installation.

Figure 5:
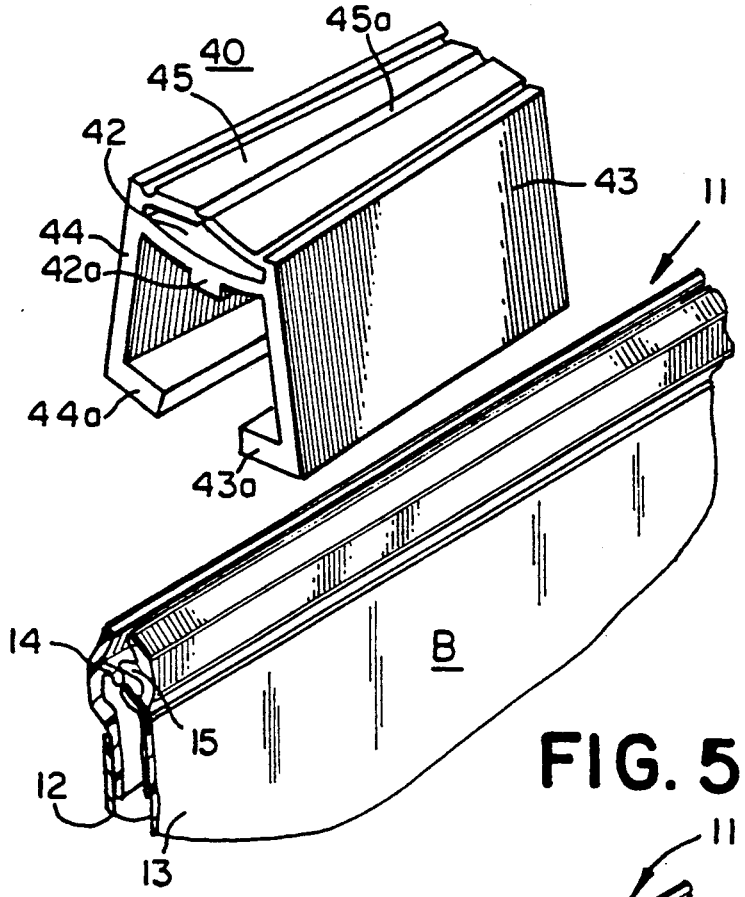
FIG. 5 is a perspective view of a flexible plastic slider embodying modification of the present invention preparatory for assembly with a profiled plastic reclosable fastener at the upper edge of the plastic-film bag.
Figure 6:
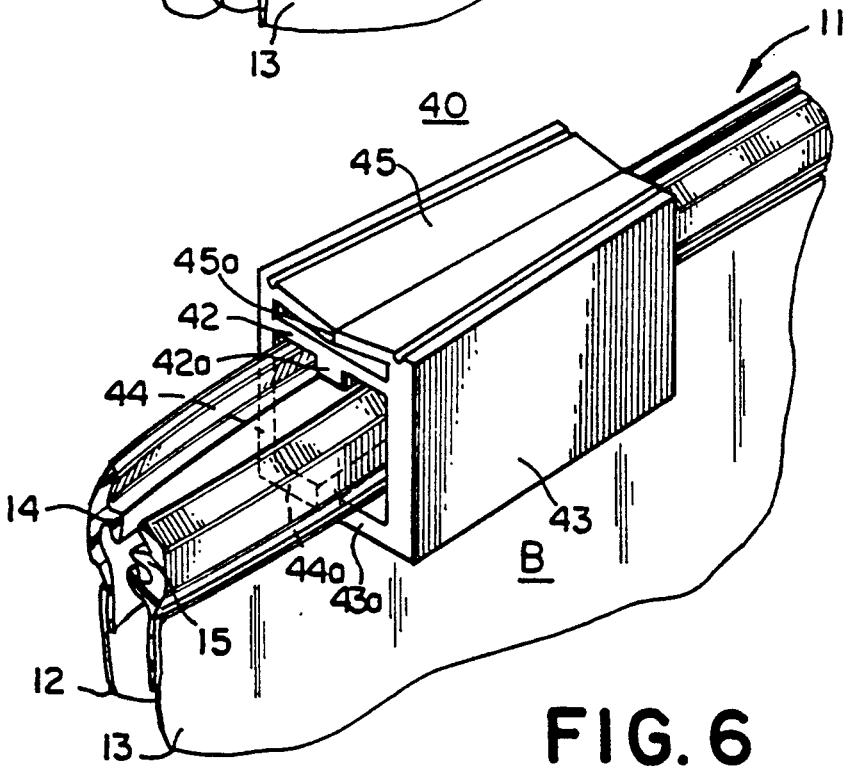
FIG. 6 is a perspective view of the plastic slider illustrated in FIG. 5 assembled on the profiled plastic reclosable fastener.

While the embodiments of the present invention of the sliders 10 and 30 illustrated in FIGS. 1, 2, 3 and 4 have both utilized two-piece constructions for the slider, it also is possible to provide a one-piece slider in accordance with the present invention. Referring to FIGS. 5 and 6 it will be seen that the slider 40 includes a flexible support member 42 in the same manner as the two-piece slider 30 illustrated in FIGS. 3 and 4. The support member 42 is provided with two rigid depending sidewalls 43 and 44 having at their lower ends inwardly extending shoulder structures 43*a* and 44*a*. The support member 42 has a separator finger 42*a* depending therefrom for insertion between the elements 14 and 15 of the reclosable fastener 11. Instead of using a separate keystone-shaped member to straighten and rigidize the support member 42 in the embodiment illustrated in FIGS. 5 and 6, this embodiment employs a molded-in hinged rigidizing member 45 that has two relatively rigid portions separated by a thinned "hinge" area 45*a*. The outer edges of the hinged rigidizing member 45 are connected to the upper ends of the sidewalls 43 and 44 respectively. The hinged rigidizing member 45 is molded initially to bow upward away from the flexible support member 42. When the rigidizing member 45 is pressed downward, as shown in FIG. 6, it straightens the support member 42 and goes "over center" so that it remains bowed slightly downward against the support member 42 and keeps the support member 42 straight. In this rigidized condition as shown in FIG. 6, the slider 40 cannot be removed from the reclosable fastener 11.

Figure 7:
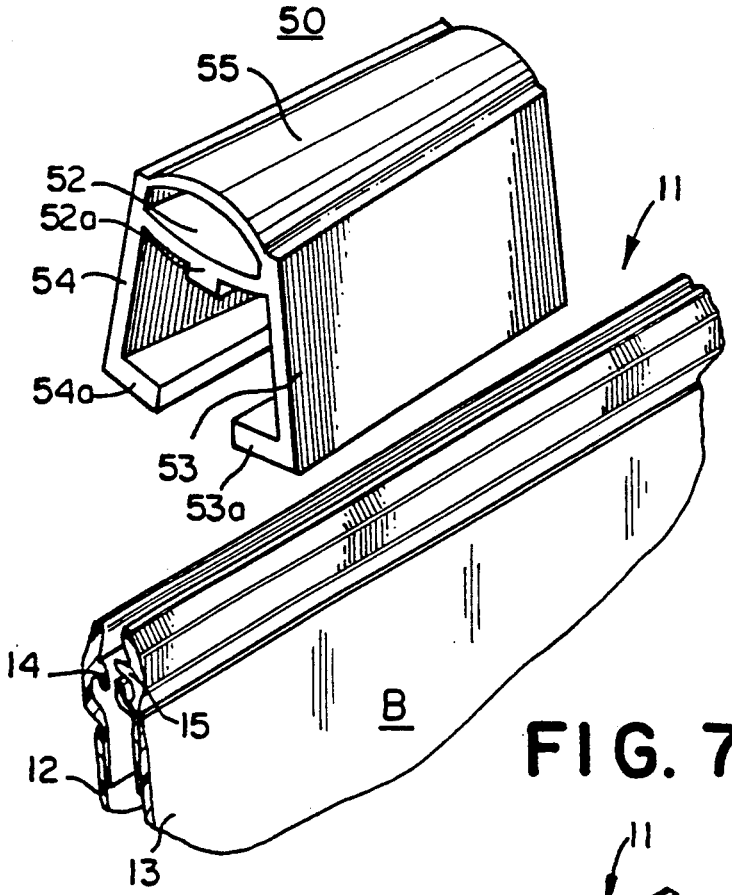
FIG. 7 is a perspective view of a flexible plastic slider embodying another modification of the present invention preparatory for assembly with a plastic profiled reclosable fastener at the upper edge of a plastic-film bag.
Figure 8:
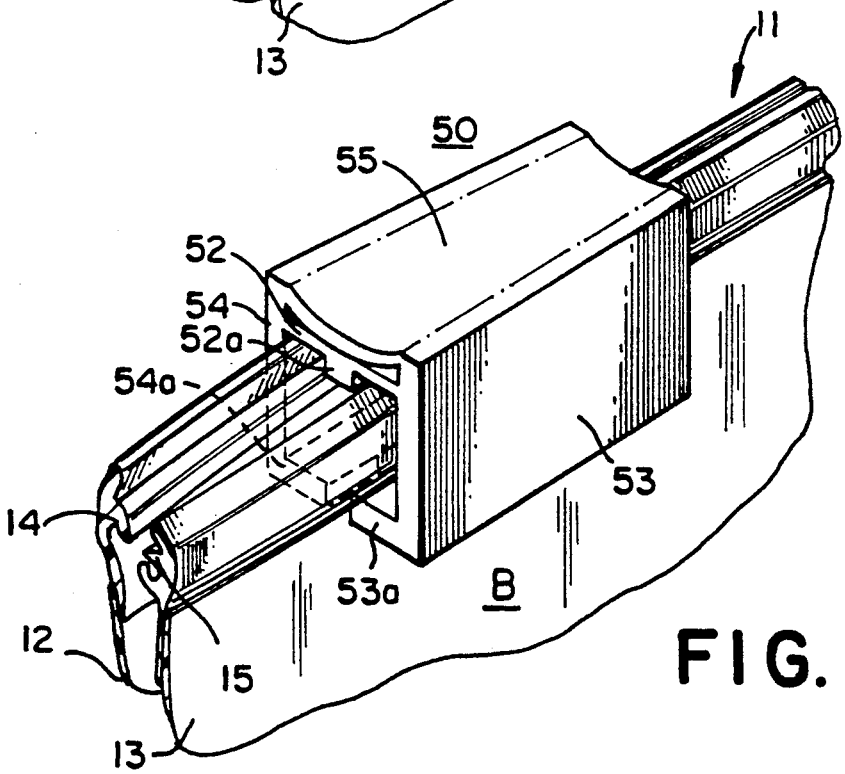
FIG. 8 is a perspective view showing the plastic slider illustrated in FIG. 7 assembled on the profiled plastic reclosable fastener.

Referring to FIGS. 7 and 8 there is illustrated another embodiment of the present invention utilizing a one-piece construction similar to that shown in FIGS. 5 and 6 but wherein the rigidizing member for the slider is not hinged. As shown in FIG. 7 the slider 50 includes a relatively flexible support member 52 having a separator finger 52*a* depending therefrom for insertion between the upper edges of the profiled elements 14 and 15 of the zipper 11. The opposite edges of the support member 52 are connected to rigid sidewalls 53 and 54 having at their lower ends inwardly extending shoulder structures 53*a* and 54*a*. The support member 52 is molded with a slight curvature so that the sidewalls 53 and 54 diverge outwardly and thus allow the slider 50 to be installed over the profiled elements 14 and 15 of the fastener 11 without interference. As may be seen in FIG. 7 the slider is provided with rigidizing structure to move the sidewalls into and retain them in an assembled position. The rigidizing structure comprises a flexible member 55 positioned above the support member 52 and having the opposite edges of the flexible member 55 connected with the upper ends of the pair of sidewalls 53 and 54. The flexible member 55 is initially convex in configuration to permit the pair of sidewalls, 53, 54 to maintain a diverging outward condition. The flexible member 55 is constructed so that when pressed downward, the flexible member 55 moves over-center from a convex to a concave configuration thereby straightening the support member 52 and locking the support member 52 in its straightened condition as shown in FIG. 8, with the pair of sidewalls 53 and 54 moved to a non-diverging condition. As shown in FIG. 8, the shoulders 53*a*, 54*a* on the sidewalls 53, 54 cooperate with the bottom of the reclosable fastener 11 to prevent the slider 50 from being lifted off the fastener 11 after the slider 50 has been installed.

Figure 9:
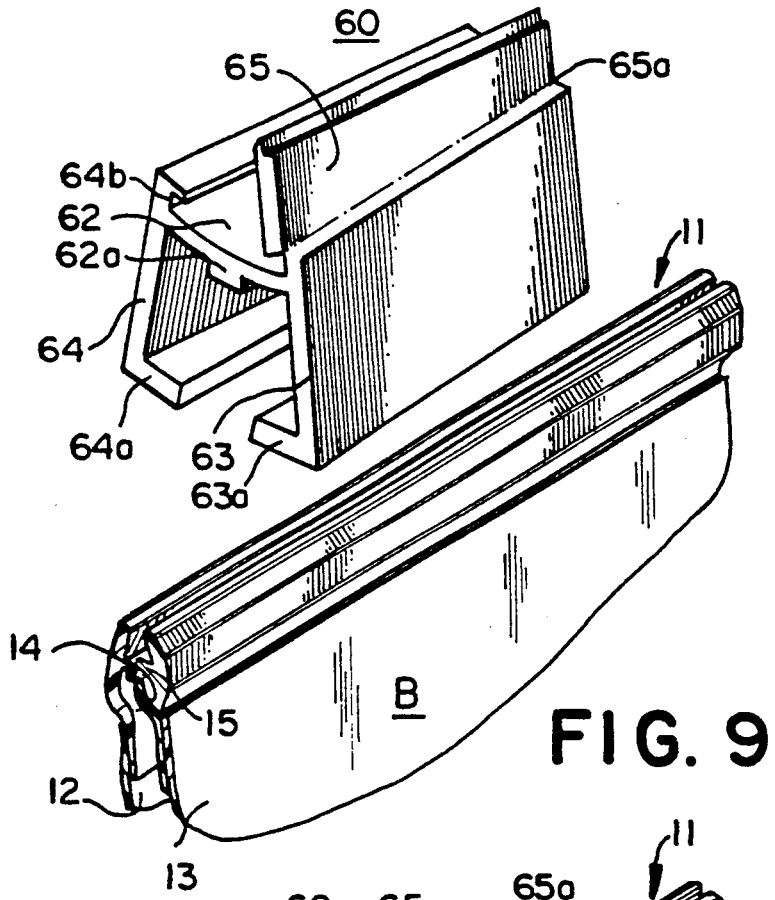
FIG. 9 is a perspective view of a flexible plastic slider embodying another modification of the present invention preparatory for assembly with a profiled plastic reclosable fastener at the upper edge of a plastic-film bag.
Figure 10:
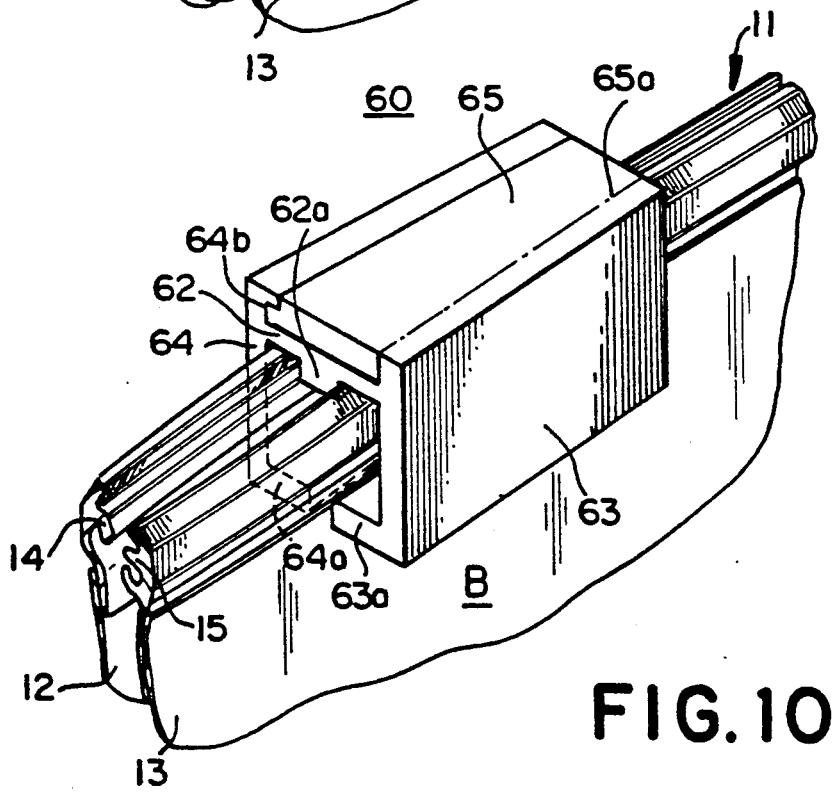
FIG. 10 is a perspective view showing the plastic slider of FIG. 9 assembled on the profiled plastic reclosable fastener.

Referring to FIGS. 9 and 10 there is illustrated another embodiment of the present invention utilizing a one-piece construction. In FIGS. 9 and 10 there is illustrated a slider 60 in which the over-center rigidizing member 55 of the embodiment of FIGS. 7 and 8 has been replaced with a rigid member 65 hinged at one edge 65*a* as shown in FIG. 9. In the slider 60 shown in FIGS. 9 and 10 there is provided a relatively flexible support member 62 having a depending finger 62*a*. The support member 62 has a pair of rigid sidewalls 63 and 64 connected to the opposite edges thereof. The depending sidewalls 63 and 64 have inwardly extending shoulders 63*a* and 64*a* at the lower edges thereof. The flexible support member 62 is bowed downwardly for maintaining the depending sidewalls 63 and 64 of the uninstalled slides in outwardly diverging relation. The upper ends of the sidewalls 63 and 64 extend above the support member 62. The rigidizing structure on the slider 60 for moving the sidewalls 63 and 64 into and retaining them in an assembled position comprises a rigid member 65 positioned above the support member 62 and hinged along one edge 65*a* to the upper end of the sidewall 63. The support member 62 is flexible so that when the slider 60 is positioned on the profiled elements 14, 15 of the fastener 11, the rigid member 65 is hinged down into a receptacle 64*b* formed between the upper ends of the sidewalls 63 and 64 atop the flexible support member 62 thereby flattening the support member 62 and maintaining the support member in a flattened position and locking the slider 60 in place on the fastener 11. This is best seen in FIG. 10. As may be seen in FIGS. 9 and 10 when the rigidizing member 65 is pressed down into its receptacle atop the flexible support member 62, it latches with a one-way snap fit at 64*b*.

The various sliders 10, 30, 40, 50 and 60 illustrated in the various embodiments of the invention may be molded from any suitable plastic such for example as nylon, polypropylene, polystyrene, Delrin or ABS. All of the sliders whether of two-piece construction or one-piece construction can be assembled as a single component onto the reclosable fastener of the bags and in a direction transverse to the fastener. This provides for ease in assembly of the slider with the reclosable fastener and avoids interference with or deformation of the fastener during the transverse assembly of the slider therewith.

While preferred embodiments of the invention have been described and illustrated, it is to be understood that further modifications thereof may be made within the scope of the appended claims without departing from the spirit of the invention.

What is claimed is:

1. A plastic slider for straddling a profiled plastic reclosable fastener particularly suited for plastic-film bags for opening and closing the fastener, the slider being constructed for assembly with the fastener by transverse movement, the slider comprising a support member having a separator finger depending therefrom for insertion between the profiled elements of the reclosable fastener, a pair of sidewalls depending from the support member and located on opposite sides of said separator finger, said sidewalls having at the lower ends thereof inwardly extending shoulder structures, said sidewalls diverging outwardly in an uninstalled slider so that said inwardly extending shoulder structures are spaced apart a distance adequate for transverse installation of the slider over the profiled elements of the reclosable fastener without interference, and rigidizing means on the slider to move the sidewalls into and retain them in an assembled position on the fastener whereby said shoulders cooperate with the bottom of the reclosable fastener to prevent the slider from being lifted off the fastener while the slider straddles the fastener.

2. A plastic slider according to claim 1 wherein said rigidizing means on the slider to move the sidewalls into and retain them in an assembled position comprises a U-shaped elongated outer member carried by said support member and adapted for movement downwardly over said sidewalls to cause said sidewalls to move from their diverging position to the assembled position with said shoulders engaging the profiled elements of the fastener.

3. A plastic slider according to claim 2 wherein said sidewalls are relatively flexible and said U-shaped member is rigid whereby when the U-shaped member is snapped into place over the support member the sidewalls are pressed inwardly so that the shoulders engage the profiled elements of the fastener to prevent removal of the now-rigid slider from the fastener.

4. A plastic slider according to claim 1 wherein said support member is a flexible member bowed downwardly for maintaining the depending sidewalls of the uninstalled slider in outwardly diverging relation and said rigidizing means on the slider to move the sidewalls into and retain them in an assembled position comprises a member slidably engaged with the support member and with the upper ends of the sidewalls, the slidable member being constructed to be axially pressed into place to straighten the support member thereby causing the sidewalls to converge so that their shoulders engage the profiled elements to prevent removal of the slider from the fastener.

5. A plastic slider according to claim 1 wherein said support member is a flexible member bowed downwardly for maintaining said sidewalls of an uninstalled slider in diverging position and said rigidizing means on the slider for moving the sidewalls into and retaining them in an assembled position comprises an over-center rigidizing member located above the support member and having its opposite edges connected to the pair of sidewalls, said over-center rigidizing member comprising two rigid portions separated by a thinned hinge area normally bowing upward away from the flexible support member whereby when the over-center rigidizing member is pressed downward the support member straightens and the rigidizing member moves over center and remains bowed slightly against the support member to maintain the support member straight.

6. A plastic slider according to claim 1 wherein said support member is flexible and bowed downwardly for maintaining the depending sidewalls of an uninstalled slider in outwardly diverging relation, the upper ends of said sidewalls extending above said support member, said rigidizing means on the slider to move the sidewalls into and retain them in an assembled position comprises a flexible member positioned above said support member and having the opposite edges of said flexible member connected with the upper ends of said pair of sidewalls, said flexible member being initially convex in configuration to permit said pair of sidewalls to maintain a diverging outward condition, said flexible member being constructed so that when pressed downward the flexible member moves over center from a convex to a concave configuration thereby straightening the support member and locking the support member in its straightened condition with the pair of sidewalls moved to a non-diverging condition.

7. A plastic slider according to claim 1 wherein said support member is flexible and bowed downwardly for maintaining the depending sidewalls of an uninstalled slider in outwardly diverging relation, the upper ends of said sidewalls extending above said support member, said rigidizing means on the slider to move the sidewalls into and retain them in an assembled position comprises a rigid member positioned above said support member and hinged along one edge to the upper end of one of said sidewalls, said support member being flexible so that when the slider is positioned on the profiled elements, the rigid member is hinged down into a receptacle formed between the upper ends of the sidewalls atop the flexible support member thereby flattening the support member and maintaining the support member in a flattened position and locking the slider in place on the fastener.

* * * * *